US007866492B2

(12) United States Patent
Walter

(10) Patent No.: US 7,866,492 B2
(45) Date of Patent: Jan. 11, 2011

(54) DEVICE FOR SUSPENDING ARTICLES OR FOR HOLDING A SHELF, AND STRUCTURE PROVIDED THEREWITH

(75) Inventor: Herbert Walter, Müllheim (DE)

(73) Assignee: Visplay International AG, Muttenz (CH)

( * ) Notice: Subject to any disclaimer, the term of this patent is extended or adjusted under 35 U.S.C. 154(b) by 584 days.

(21) Appl. No.: 11/884,422

(22) PCT Filed: Dec. 20, 2005

(86) PCT No.: PCT/CH2005/000761

§ 371 (c)(1),
(2), (4) Date: Aug. 15, 2007

(87) PCT Pub. No.: WO2006/086897

PCT Pub. Date: Aug. 24, 2006

(65) Prior Publication Data

US 2008/0217271 A1 Sep. 11, 2008

(30) Foreign Application Priority Data

Feb. 19, 2005 (DE) ..... 20 2005 002 740 U

(51) Int. Cl.
*A47H 1/00* (2006.01)

(52) U.S. Cl. ..... 211/103

(58) Field of Classification Search ..... 211/103, 211/187, 190, 207; 248/220.21, 220.22, 248/222.11, 224.7
See application file for complete search history.

(56) References Cited

U.S. PATENT DOCUMENTS 2,516,907 A * 8/1950 Penfold ..... 285/7
2,933,196 A * 4/1960 Childs ..... 211/183
3,265,217 A * 8/1966 Biggs ..... 211/90.02
4,160,506 A * 7/1979 Young, Jr. ..... 211/106.01

(Continued)

FOREIGN PATENT DOCUMENTS

DE 202 02 856 U1 6/2002

(Continued)

OTHER PUBLICATIONS

Written Opinion issued by the ISA in connection with International Patent Appln. No. PCT/CH2005/000761.

(Continued)

*Primary Examiner*—Sarah Purol
(74) *Attorney, Agent, or Firm*—McCarter & English, LLP

(57) ABSTRACT

A suspension device includes a holder (3) for fixing to a carrier structure (7) and a plug-in socket (1) for inserting into the holder (3). A carrier (4) includes a plug-in element (400) that can be inserted into the plug-in socket (1) in a lockable manner. A flange (30) on the holder (3) is used to fix the holder to the carrier structure (7). A housing is connected to the flange (30). The holder (3) has a fixing mechanism for the fixed but detachable anchoring of the plug-in socket (1) inserted into the receiving region. A shaft is connected to the flange (10). The socket shaft includes a locking element (17) for the detachable engagement of the plug-in element (400) introduced into the socket shaft. A counter-element (403) on the plug-in element (400) cooperates with the locking element (17).

11 Claims, 14 Drawing Sheets

U.S. PATENT DOCUMENTS

| | | | | |
|---|---|---|---|---|
| 4,223,966 | A * | 9/1980 | Winters | 312/140 |
| 5,186,341 | A * | 2/1993 | Zeid | 211/204 |
| 5,205,524 | A * | 4/1993 | Cohen | 248/235 |
| 5,961,082 | A * | 10/1999 | Walter | 248/220.21 |
| 6,085,916 | A * | 7/2000 | Kovacevic et al. | 211/86.01 |
| 6,182,937 | B1 * | 2/2001 | Sanderse | 248/466 |
| 6,371,313 | B1 * | 4/2002 | Walter et al. | 211/123 |
| 6,561,474 | B1 * | 5/2003 | Walter et al. | 248/220.22 |
| 6,631,813 | B1 * | 10/2003 | Walter et al. | 211/94.01 |
| 2005/0056604 | A1 * | 3/2005 | Chen | 211/182 |

FOREIGN PATENT DOCUMENTS

| | | | |
|---|---|---|---|
| DE | 202 02 761 | U1 | 7/2002 |
| DE | 203 19 266 | U1 | 4/2004 |
| DE | 20 2004 004 783 | U1 | 7/2004 |
| DE | 20 2004 017 332 | U1 | 3/2005 |
| WO | WO99/20094 | | 4/1999 |

OTHER PUBLICATIONS

International Search Report issued by the ISA in connection with International Patent Appln. No. PCT/CH2005/000761.

* cited by examiner

Fig. 4A
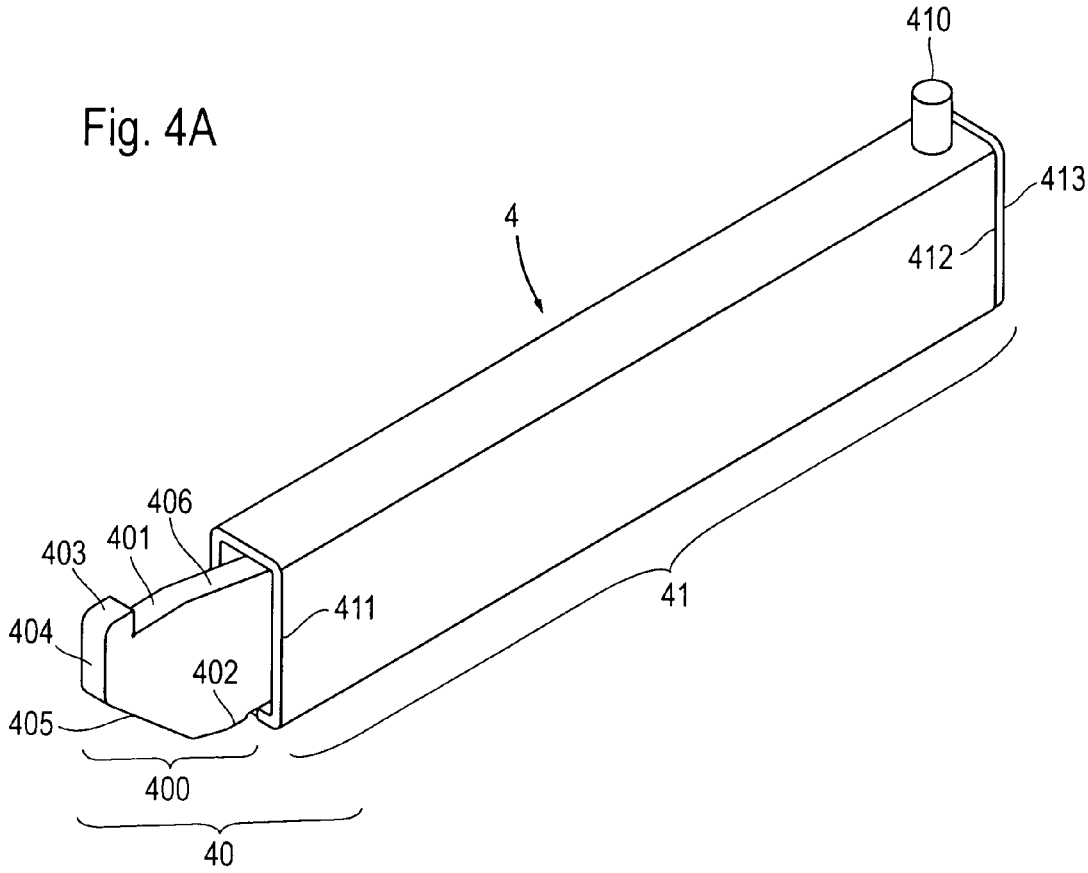
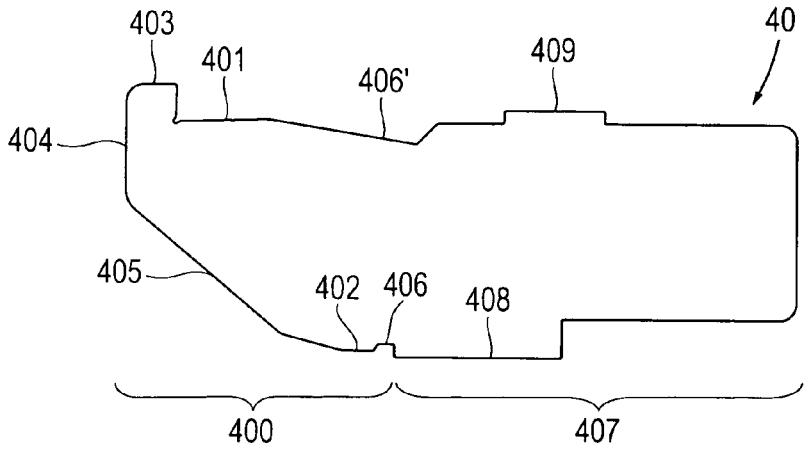
Fig. 4B

Fig. 5A
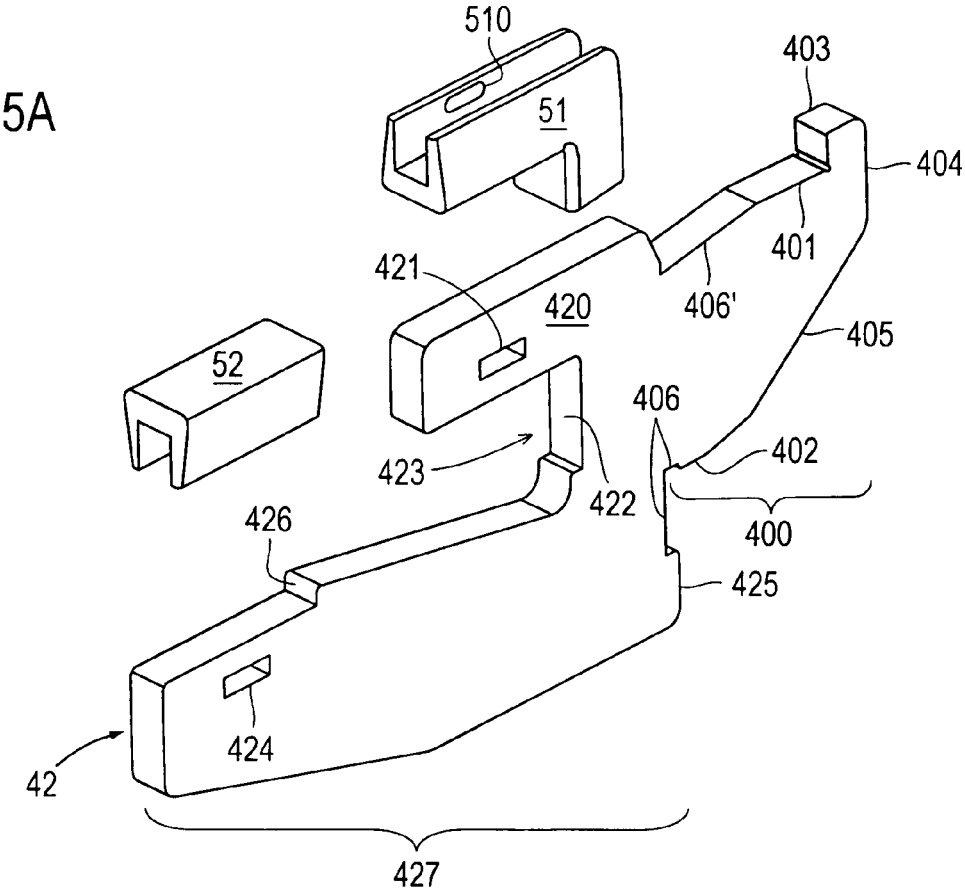
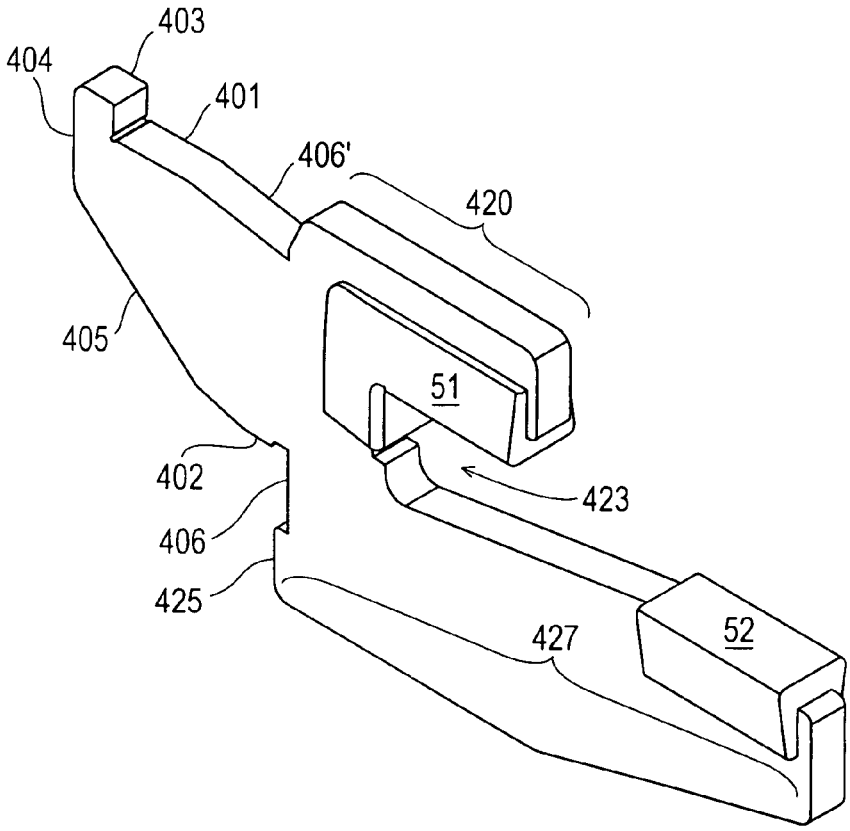
Fig. 5B

Fig. 7A
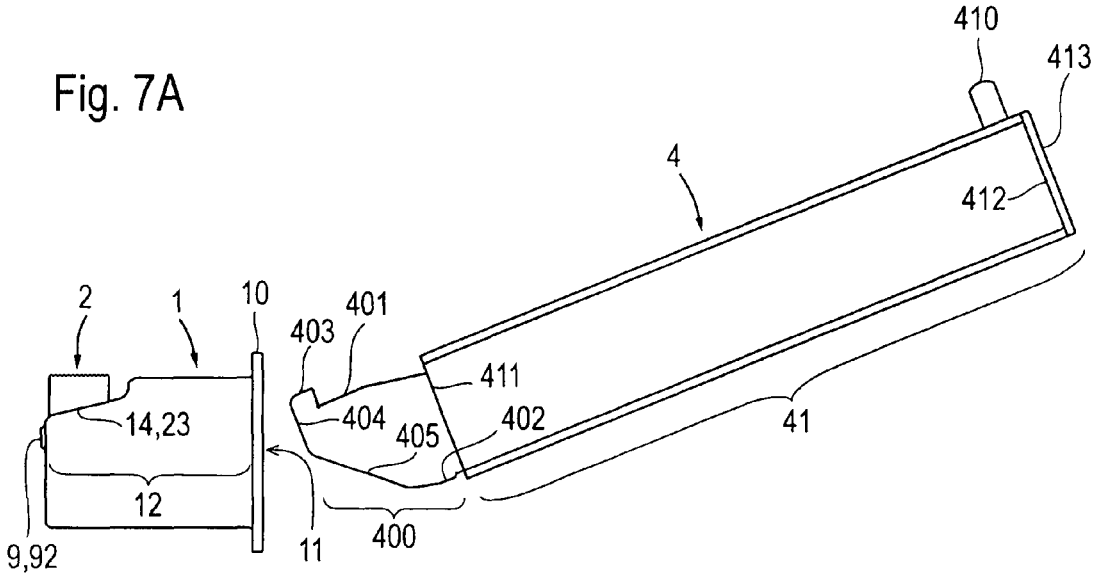
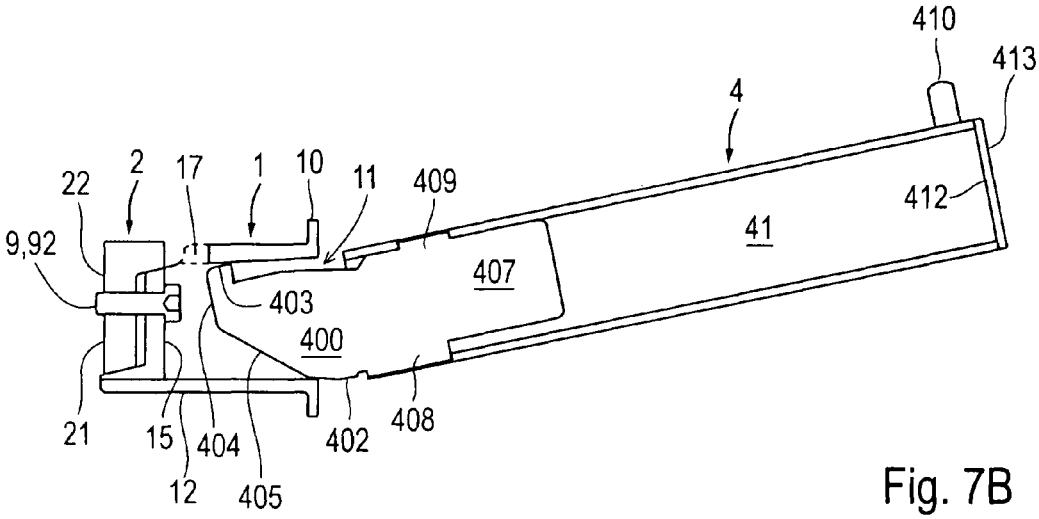
Fig. 7B

DEVICE FOR SUSPENDING ARTICLES OR FOR HOLDING A SHELF, AND STRUCTURE PROVIDED THEREWITH

FIELD OF APPLICATION OF THE INVENTION

The invention comprises a plug-in sleeve which can be inserted into a holder which is received by a supporting structure, and a support which can be latched into the plug-in sleeve, thus resulting in a device for suspending articles or for holding a shelf. Typical supporting structures are panels, rear walls and pillars. Devices of this type are essentially used in shops and in exhibitions for the presentation of goods. The articles displayed—for example articles of clothing, accessories and goods packaging—can be attached directly to a correspondingly provided support, or the support supports a shelf which can have, for example, the form of an actual shelf, a box or a basket.

PRIOR ART

Many plug-in sleeves with supports which can be inserted therein are known, for example from WO 99/20097 A2, DE 202 02 761 U1 and DE 20 2004 004 783 U1. In these solutions, the plug-in sleeves are inserted into a panel and are secured by means of a flange screw which can be screwed on the rear side and at the same time is intended to absorb, over as large a surface area as possible, the forces which are in action. DE 202 02 856 U1 discloses an alternative, according to which the plug-in sleeve is surrounded by a fixed flange which is screwed against a panel from the rear side.

The applicant's most recent developments according to DE 203 19 266 U1 and DE Utility Model 20 2004 017 332.8, which has initially merely been registered, provide a separate holder into which the plug-in sleeve is inserted and which absorbs the load introduced by the support latched into the plug-in sleeve. The holder can be arranged on the visible panel or can be inserted into a substructure which can be subjected to a higher load and which then just has an unloaded covering placed in front of it.

OBJECT OF THE INVENTION

In view of the advantages of three-part devices, comprising holder, plug-in sleeve and support, the invention is based on the object of simplifying the components, of designing them to be more practical for handling and, by means of design conception, making series production which is more efficient in terms of cost possible. Finally, it is an object to indicate preferred variant structures having the device to be provided.

SUMMARY OF THE INVENTION

The device for suspending articles or for holding a shelf firstly comprises a holder which is intended for fastening to a supporting structure, and, furthermore, a plug-in sleeve which is provided for inserting into the holder. Finally, the device includes a support which has a plug-in part to be introduced in a lockable manner into the plug-in sleeve. The holder has a vertically arranged flange which serves for the fastening to the supporting structure. A housing is connected to the flange and has an opening which leads into an inner receiving space. On the holder there are fixing means for the fixed, releasable securing of the plug-in sleeve inserted in the receiving space of the holder housing. The plug-in sleeve has a flange which surrounds a window-like mouth of a passage. The flange is adjoined by a shaft into which the passage extends. Fixing means of the plug-in sleeve interact with those of the holder. For the releasable engagement of the plug-in part introduced into the sleeve shaft, the sleeve shaft has a locking element. The plug-in part has a counter-element which interacts with the locking element in the sleeve shaft. The fixing means of the holder housing is the inner housing wall thereof, and the fixing means of the plug-in sleeve is an adjustable wedge pressing against the housing wall. The locking element in the sleeve shaft is a clearance, and the complementary counter-element on the plug-in part is an upwardly directed lug.

Specific embodiments of the substructure are described below: for the adjustment of the wedge, use is made of a screw which has a seat in the sleeve shaft and, for the movement, is accessible through the passage. The screw engages by means of its threaded shank in the wedge. The upper side of the sleeve shaft has a wall slope on which the wedge can slide to a limited extent. With the plug-in sleeve fixed in the holder housing, the upper side of the wedge, which is preferably provided with texturing, is pressed against the ceiling of the holder housing. The screw seat in the sleeve shaft is upwardly open, an upwardly open slot extends into the transverse wall which forms the seat, and the sleeve shaft is upwardly open as far as the rear end in the region of the wall slope, as a result of which the screw can be placed from above into the seat. The wedge has a lower segment with an internal threaded hole for the engagement of the threaded shank of the screw, said segment being accommodated in a wedge seat in the sleeve shaft. The locking element in the sleeve shaft is provided in the form of a hole through its ceiling. In the passage there are clamping surfaces for reducing the play of an inserted plug-in part resting in the end position.

The holder flange has screw holes for fastening by means of its front side or its rear side to the supporting structure. The housing protrudes over the flange front side with an excess length and the remaining housing part rises up from the flange rear side. There are leveling and installation markings on the holder flange. The plug-in part constitutes the frontmost portion of a bracket which is composed of vertically positioned flat material. The bracket is connected fixedly to a rod part of an arm-shaped support. Or the plug-in part of the bracket continues in an upper and a lower limb between which a recess is located in order to receive the rear edge of a shelf therein.

On the plug-in part there is firstly a lower clearance cut for the transition to the rod part or to the limbs, from which a second shoulder extends in the direction of a lower bevel. A vertical front edge coming from the lug merges into the bevel. A first shoulder leads to the lug, said shoulder lying below the latter and merging into an upper clearance cut. The bracket is advantageously produced, for example, by means of laser cutting. The configuration of plug-in part and plug-in sleeve permits the plug-in part to be inserted into the plug-in sleeve only in a position of the support in which it is overall inclined with respect to the horizontal, with the plug-in part lowered. The engagement between the counter-element on the plug-in part and the locking element in the sleeve shaft, as a locked state, arises after the support moves as a whole into the horizontal with the plug-in part lying horizontally.

In one structure with the device, in the fitted state, the holder flange is fastened on the rear side of a supporting structure, and the housing excess length comes to lie in a cutout of the supporting structure. The plug-in sleeve is fixed by means of its shaft in the receiving space of the holder, and the sleeve flange sits with its rear side on the front side of the supporting structure. A support is fitted by means of its plug-in part into the passage of the plug-in sleeve.

In an alternative structure, the holder flange is fastened on the front side of a supporting structure—for example a square tube—and the housing portion located behind the holder flange projects into the supporting structure. The housing excess length projecting into the room from the front side of the holder flange lies in a cutout of a plate element which is placed in front of it and the front side of which points into the room. The plug-in sleeve is fixed by means of its shaft in the receiving space of the holder, and the sleeve flange sits with its rear side on the front side of the plate element. In the same manner, a support is fitted by means of its plug-in part into the passage of the plug-in sleeve.

BRIEF DESCRIPTION OF THE ATTACHED DRAWINGS

In the drawings:

FIG. 4A shows a support with a bracket of a first variant and straight rod part, in perspective view;

FIG. 4B shows an individual bracket from FIG. 4A, in an enlarged side view;

FIG. 5A shows a claw as the support with protective elements, in a perspective exploded view;

FIG. 5B shows the arrangement according to FIG. 5A, in assembled form, in a changed perspective;

FIGS. 7A to 7C show the principle of the function of the device in the three position phases;

FIG. 7A shows the first position phase: the approach of the support with the bracket, which is raised obliquely at the rear, toward the plug-in sleeve;

FIG. 7B shows the second position phase: the bracket partially introduced obliquely into the plug-in sleeve; and FIG. 7C shows the third position phase: the bracket fitted into the plug-in sleeve, in the end position.

EXEMPLARY EMBODIMENT

The detailed description of an exemplary embodiment of the device according to the invention in the various characteristic applications takes place below with reference to the attached drawings.

The definition below applies to all of the rest of the description. If reference numbers are contained in a figure for the purpose of graphical unambiguity, but are not explained in the directly associated text of the description, reference is made to the description thereof in the preceding or following descriptions of the figures. In the interests of clarity, the repeated designation of components is generally omitted in further figures if it can be seen unambiguously graphically that these are "recurring" components.

Figure 1A:
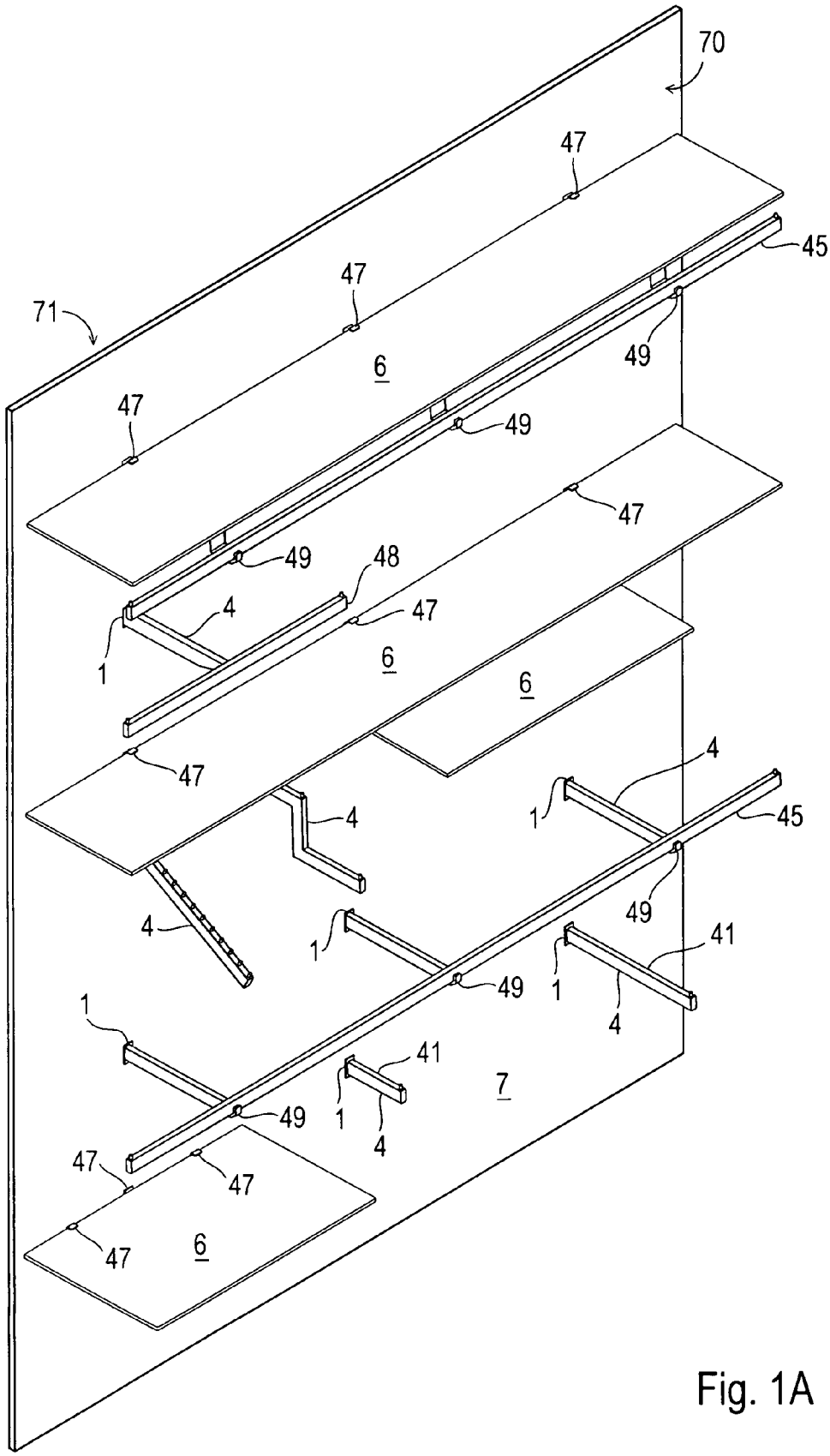
FIG. 1A shows a panel equipped in multiple rows with plug-in sleeves into which are inserted various supports by which a number of differently sized shelves are supported, in a perspective view.
Figure 1B:
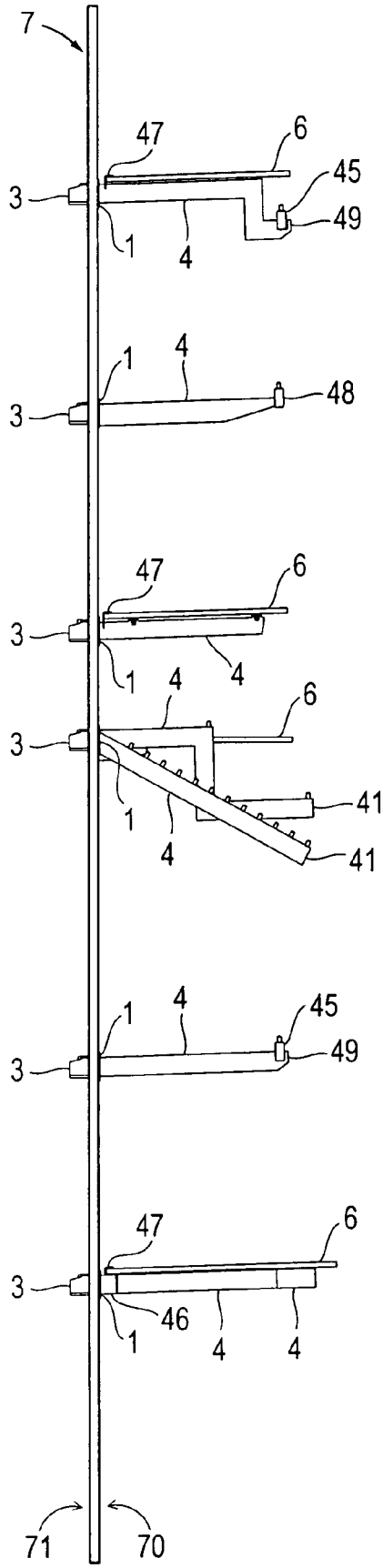
FIG. 1B shows the arrangement according to FIG. 1A, in side view.
Figure 1C:
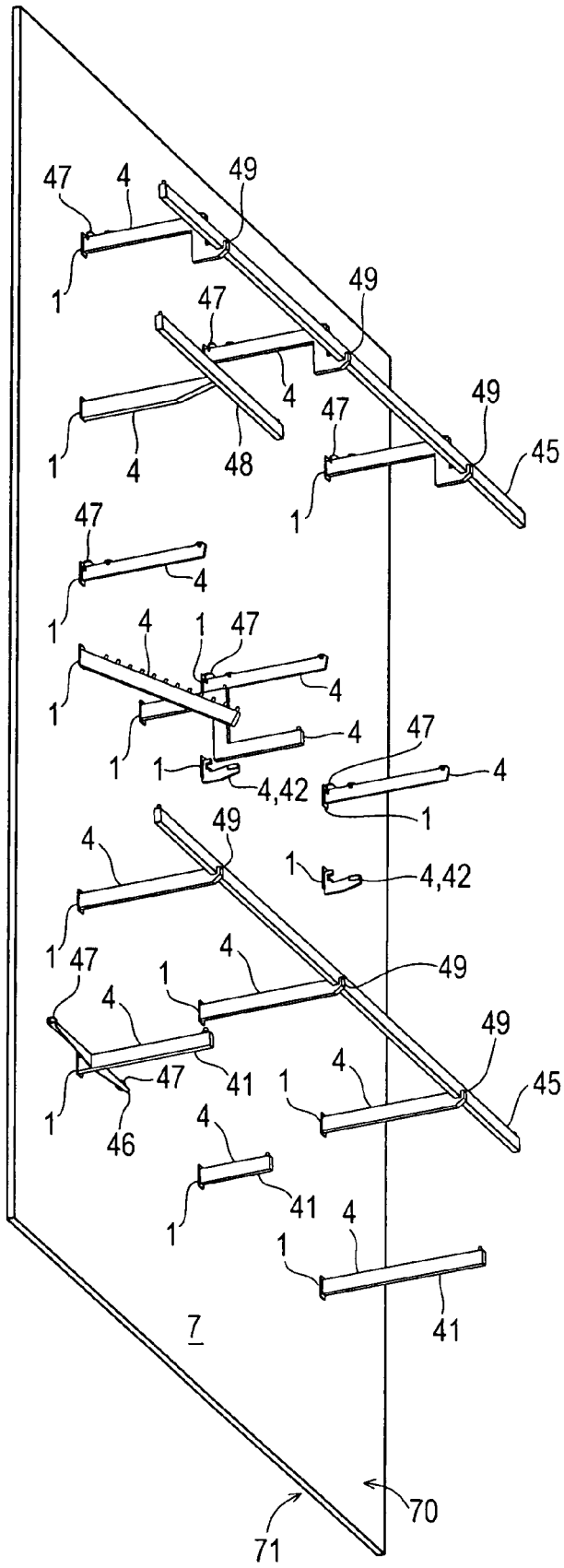
FIG. 1C shows the arrangement according to FIG. 1A, without shelves, in a perspective view.
Figure 2A:
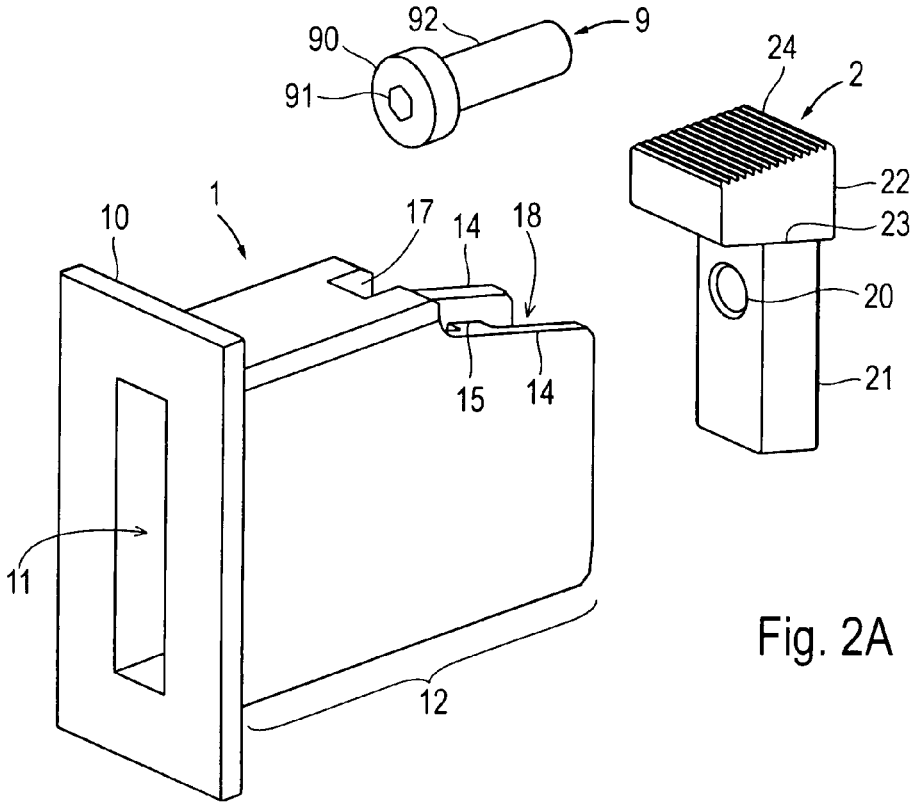
FIG. 2A shows a plug-in sleeve with wedge and screw, in a perspective exploded view of the front side.
Figure 2B:
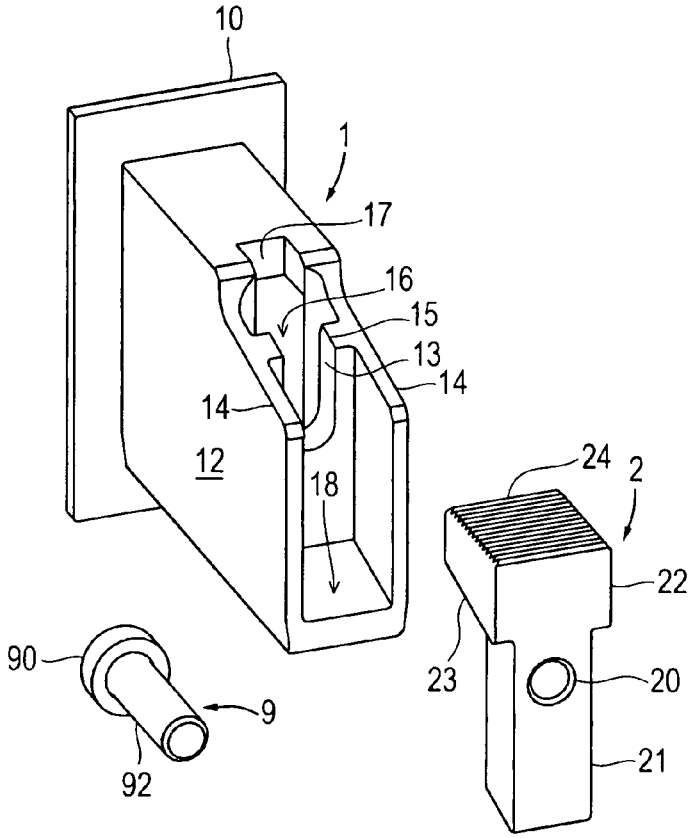
FIG. 2B shows the arrangement according to FIG. 2A, in a perspective exploded view of the rear side.
Figure 2C:
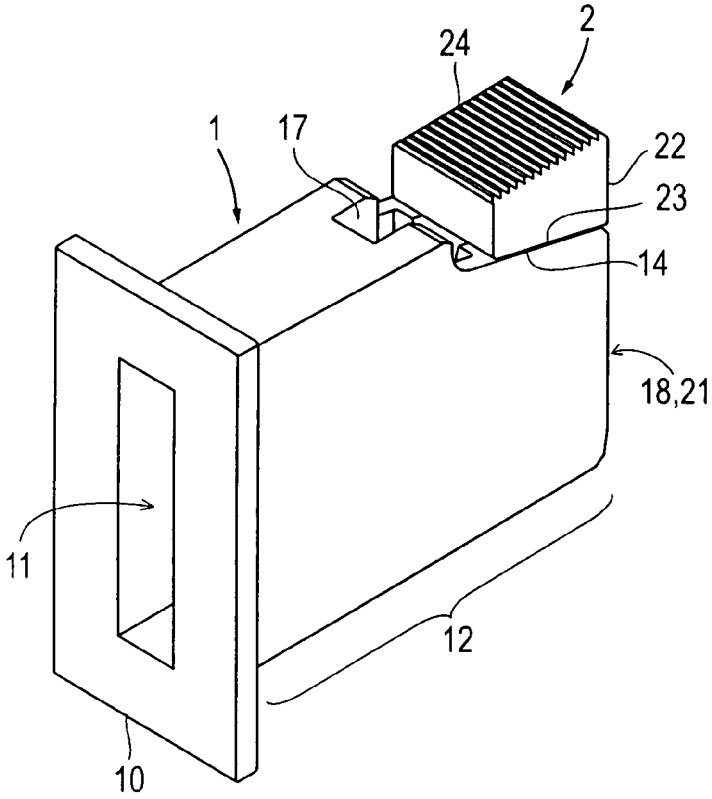
FIG. 2C shows the arrangement according to FIG. 2A, in assembled form, in a perspective view of the front side.
Figure 2D:
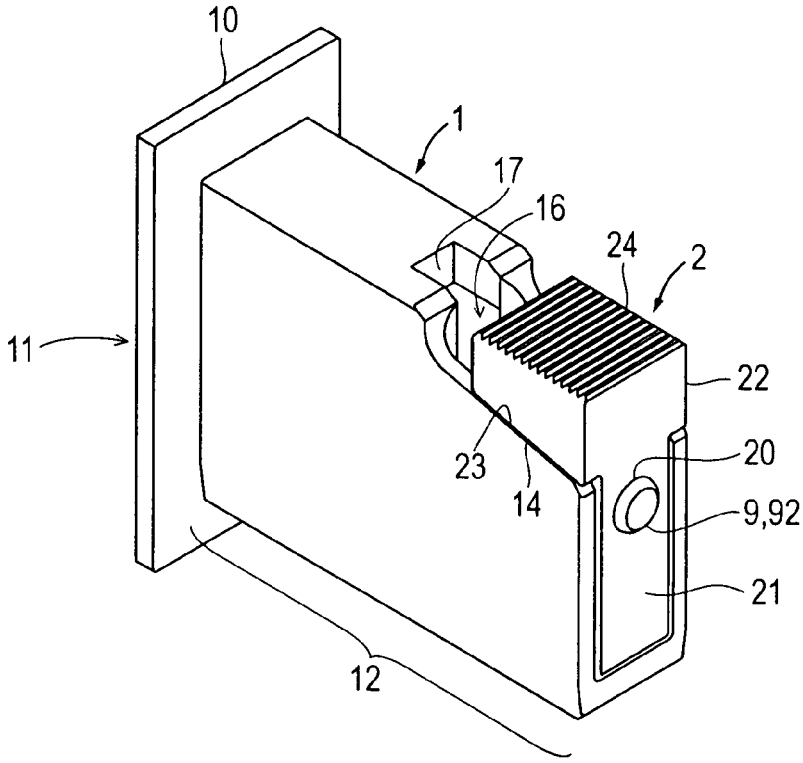
FIG. 2D shows the arrangement according to FIG. 2C, in a perspective view of the rear side.
Figure 2E:
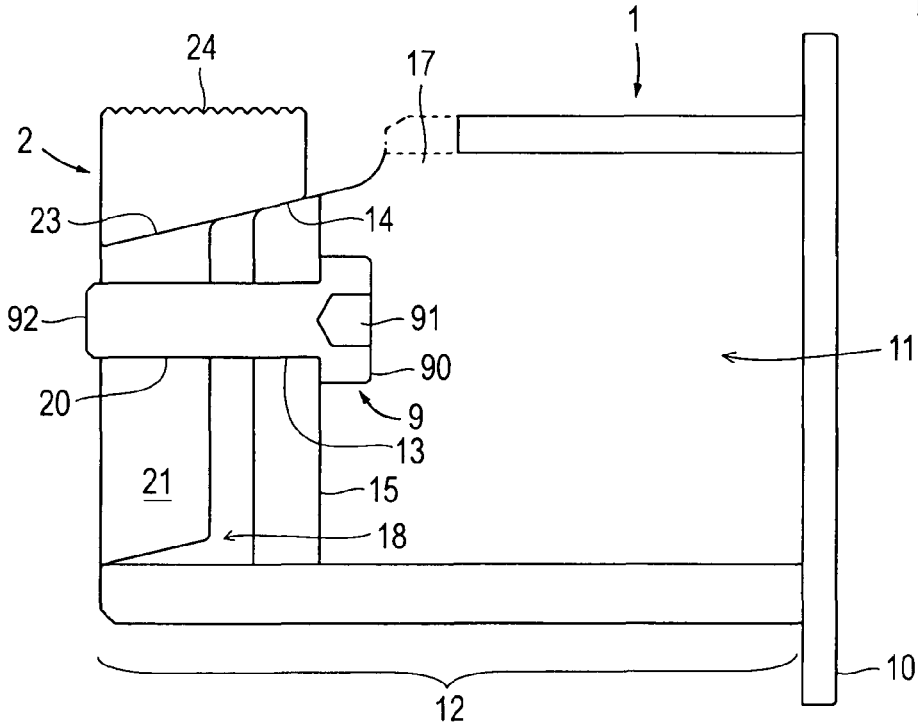
FIG. 2E shows the arrangement according to FIG. 2C, in a transparent side view.
Figure 2G:
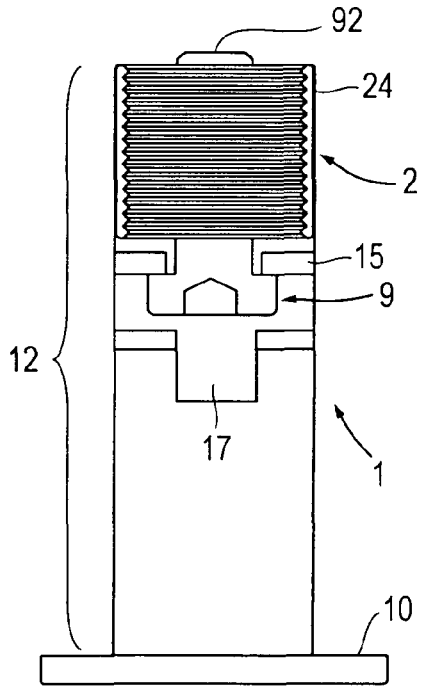
FIG. 2G shows the arrangement according to FIG. 2C, in plan view.
Figure 2F:
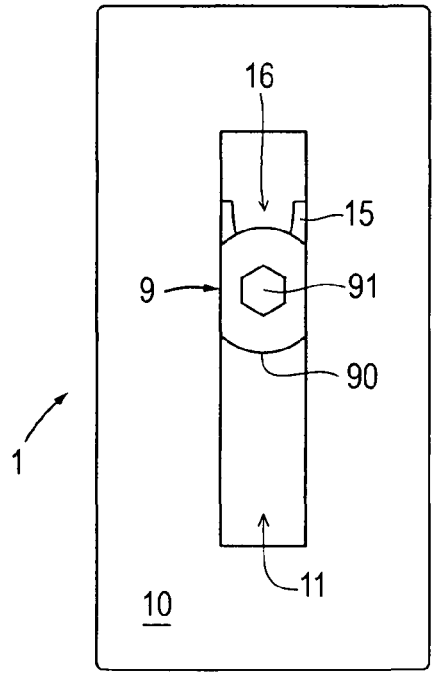
FIG. 2F shows the arrangement according to FIG. 2C, in front view.
Figure 3A:
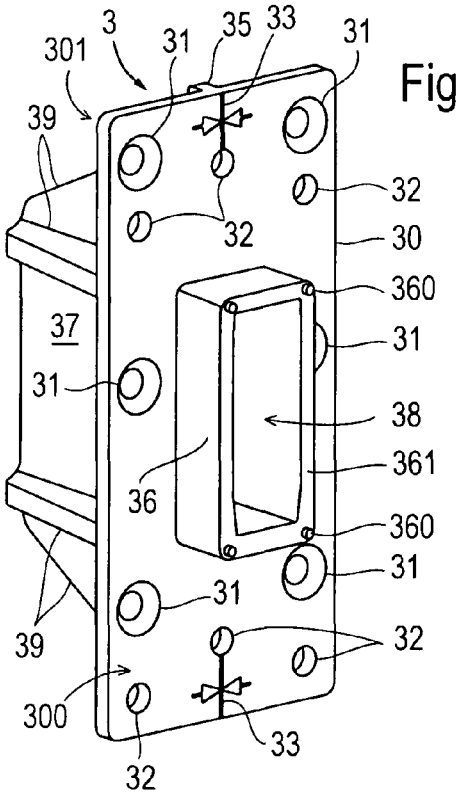
FIG. 3A shows a holder, in a perspective front view.
Figure 3B:
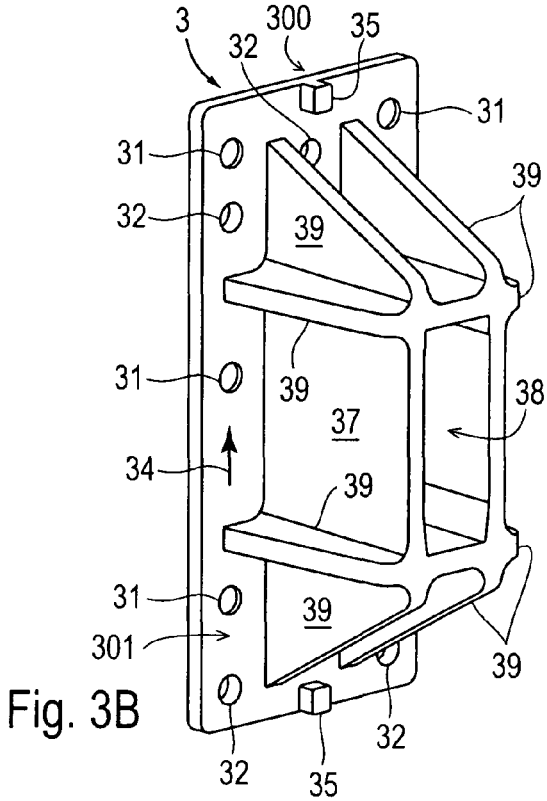
FIG. 3B shows the holder according to FIG. 3A, in a perspective rear view.
Figure 3C:
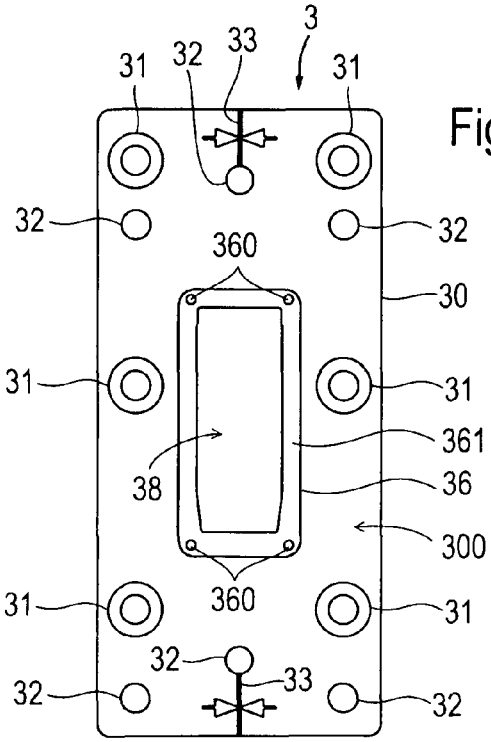
FIG. 3C shows the holder according to FIG. 3A, in front view.
Figure 3D:
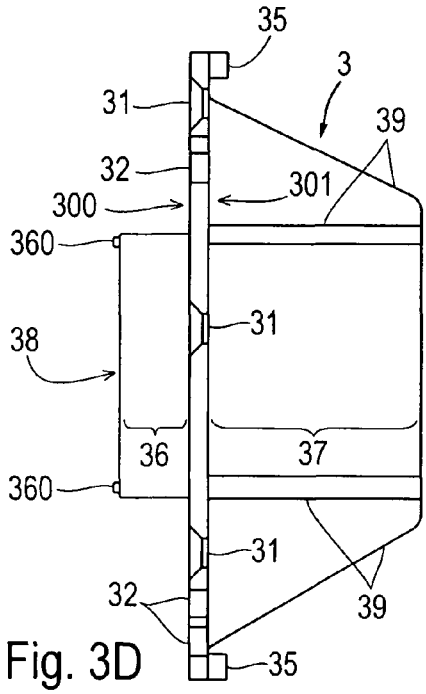
FIG. 3D shows the holder according to FIG. 3A, in side view.

FIGS. 1A to 1C

The supporting structure 7 which is erected vertically—here a plate-like panel—has holders 3 fastened to it on the panel rear side 71 in a plurality of rows at systematic distances, into which holders are inserted plug-in sleeves 1 for receiving differently configured supports 4 which can be inserted from the panel front side 70. The supports 4 in the uppermost row are of stepped designed in the front region, have, at the ends projecting into the room, a receiving means 49 for the releasable insertion of a transverse rod 45 and, in the vicinity of the panel front side 70, are provided with a holding-down means 47 in order to hold a shelf 6 stretching over the three supports 4. The support 4 in the row located therebelow has a transverse section 48 at its front end, thus producing a T-arm. In the next row, three plug-in sleeves 1 are arranged with straight supports 4 which are inserted in them and have identical holding-down means 47 in order likewise to hold a shelf 6 which rests at the same time on the front ends of the supports 4. In the row located therebelow, first of all respective supports 4 with an oblique or stepped rod part 41 are inserted. Next to them are inserted, at the same height, two mutually spaced-apart supports 4 in the form of claws 42 which are provided for holding a shorter shelf 6. In the penultimate row from below, a transverse rod 45 is held by three supports 4 which are provided with a receiving means 49 at the ends projecting into the room. Inserted in the lowermost row is a support 4 which, in the vicinity of the panel front side 70, has an extension arm 46 which is fixed transversely with respect to the straight rod part 41 of the support 4 and is provided with holding-down means 47 at the ends such that a shelf 6 is securely held on said support 4. The two remaining supports 4 inserted in the last row each have a straight rod part 41 of different length.

FIGS. 2A to 2G

The single-part plug-in sleeve 1 is essentially divided into the perpendicular, rectangular flange 10 and the shaft 12 fitted on the rear side of the flange 10. The plug-in sleeve 1 furthermore includes a wedge 2 and a screw 9 in order to fix the plug-in sleeve 1 in the holder 3, as is described further on. A window-like passage 11 opens centrally in the flange 10 and extends into the shaft 12 as far as a transverse wall 15.

Approximately half way along the shaft 12, an opening 17 emerges on the upper side, from which the upper edges drop in the form of a wall slope 14 to the rear shaft end, in which the wedge seat 18 is located. The shaft 12 is upwardly open in the region of the wall slope 14. Approximately centrally on the wall slope 14, the transverse wall 15 passes through the shaft 12 by means of an upwardly open slot 13, and therefore a screw seat 16 is produced on the transverse wall 15, on the side facing the flange 10.

The wedge 2 is composed as a single piece from the lower, first segment 21 and the wedge-shaped, second segment 22 which is arranged on top of the latter and has a greater width and thickness, but a smaller height than the first segment 21. A horizontal internal threaded hole 20 which lies coaxially with respect to the passage 11 extends through the first segment 21, which is basically cuboidal. The second segment 22, which protrudes laterally over the first segment 21 and in the direction of the flange 10, has, at the bottom, the forwardly rising oblique surfaces 23 and, on the upper side, a texturing 24, preferably in the form of a toothing. In the fitted state, the head 90 of the screw 9 is located in the screw seat 16, the screw shank 92 protrudes through the slot 13 and engages in the internal threaded hole 20 in the wedge 2. The first segment 21 has space in the wedge seat 18, while the oblique surfaces 23 on both sides of the second segment 22 sit on the wall slopes 14 of the shaft 12. The textured surface 24 lies approximately on the upper side of the flange 10 and the side flanks of the second segment 22 end approximately with the outer surfaces of the shaft 12. With increasing screwing in of the screw 9—the screw head 90 has an engagement contour 91 for the fitting of a tool—the wedge 2 is pulled further onto the flange 10, with the wedge surface 24 with the entire wedge 2 being moved upward by the oblique surfaces 23 sliding on the wall slopes 14. During installation, the screw 9 is inserted into the shaft 12 from above with the screw head 90 behind the transverse wall 15 and the screw shank 92 projecting through the slot 13. The plug-in sleeve 1 can advantageously be produced as a cast part.

FIGS. 3A to 3D

Figure 6A:
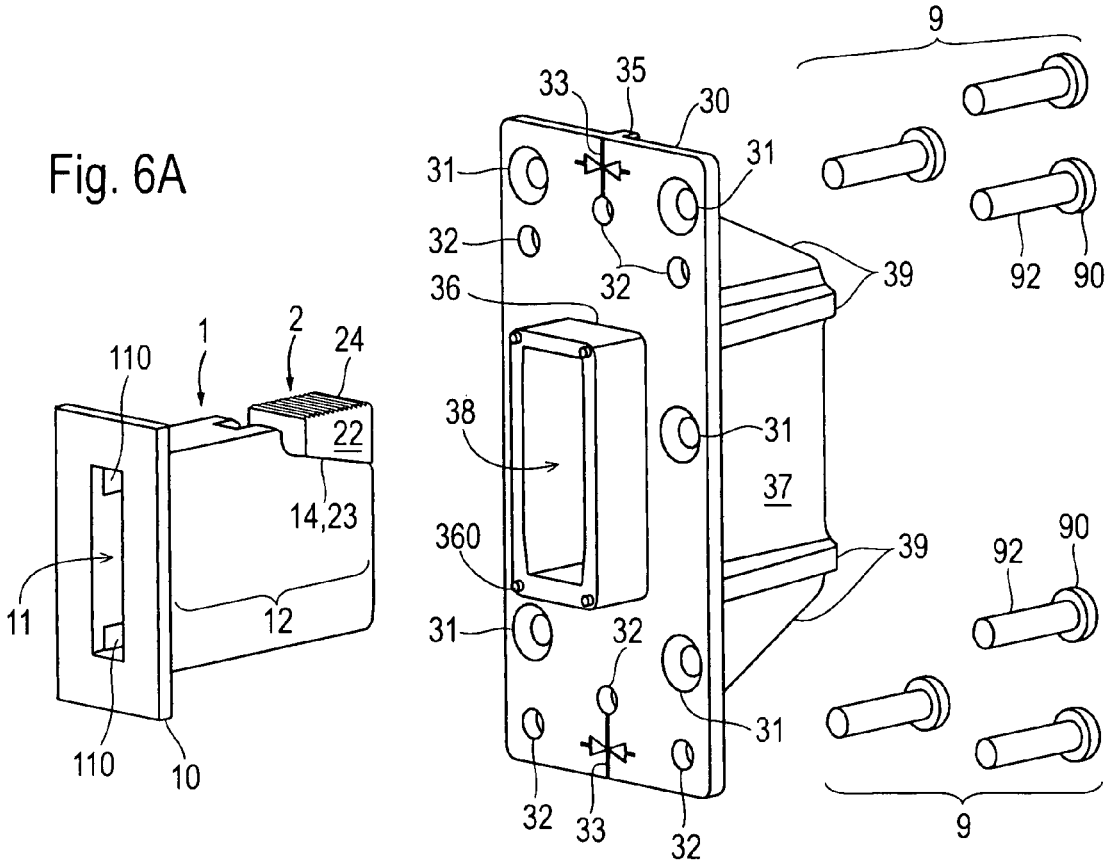
FIG. 6A shows the assembled plug-in sleeve according to FIG. 2C close to the holder according to FIG. 3A.
Figure 6B:
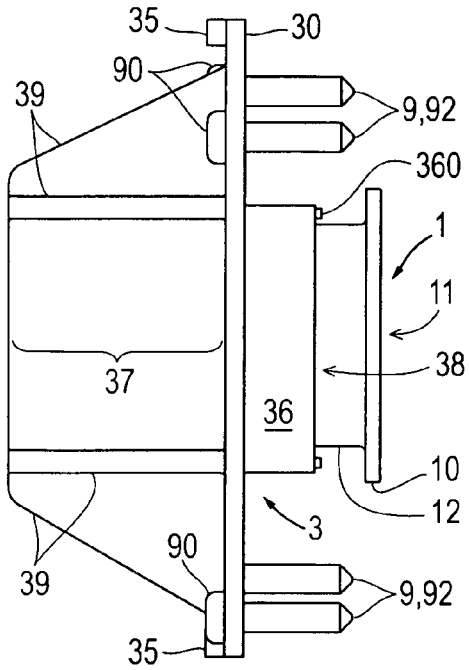
FIG. 6B shows the arrangement according to FIG. 6A, with the plug-in sleeve inserted into the holder, in side view.
Figure 6C:
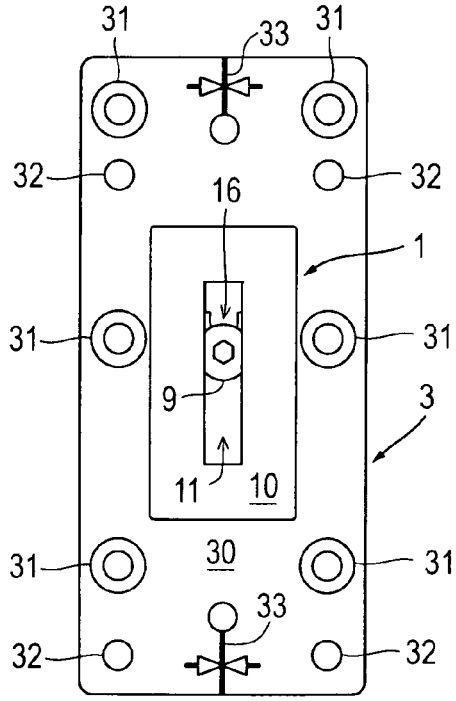
FIG. 6C shows the arrangement according to FIG. 6B, in front view.
Figure 6D:
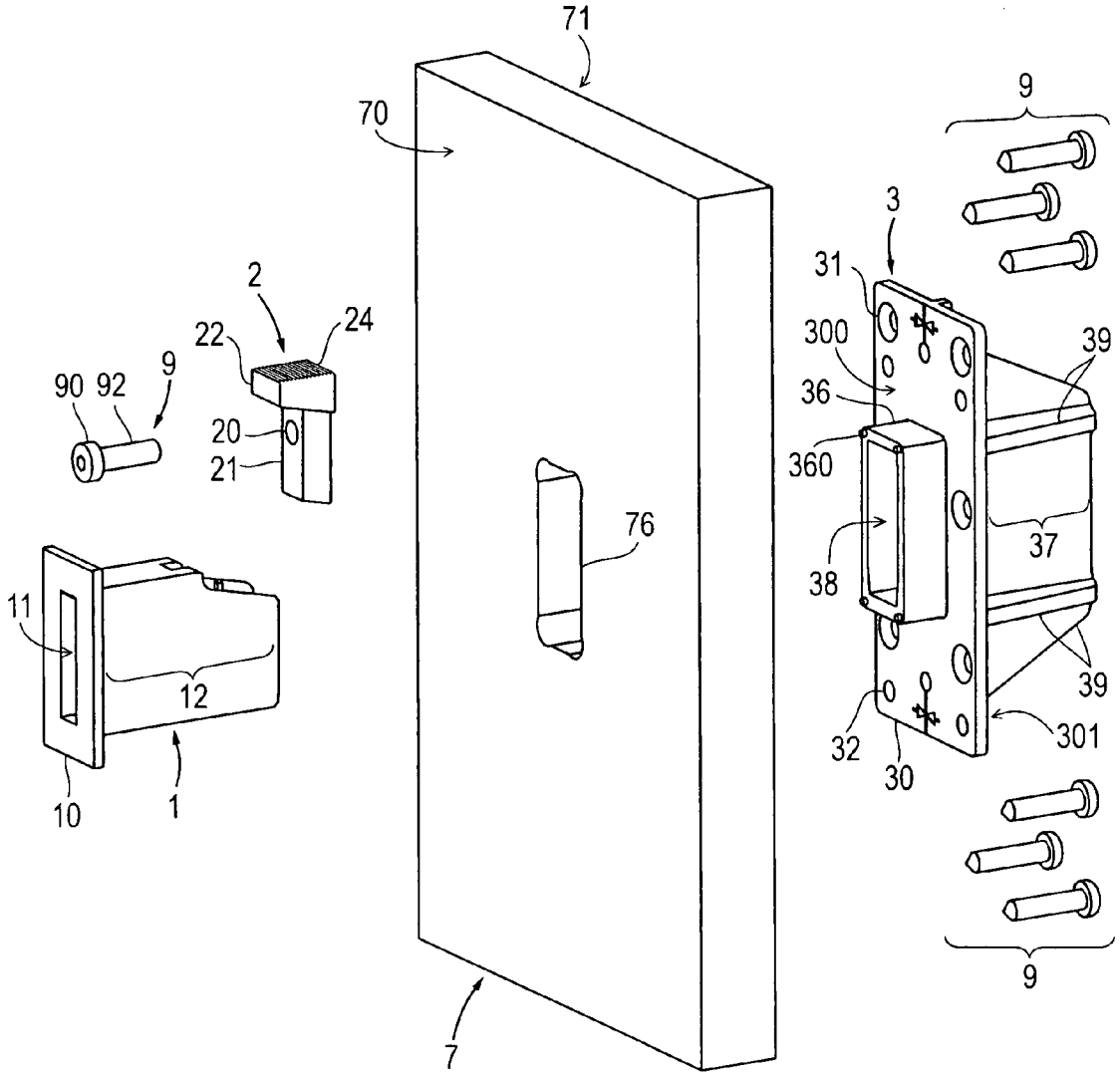
FIG. 6D shows the plug-in sleeve with wedge and screw according to FIG. 2A, a panel with a cutout and a holder according to FIG. 3A, in a perspective exploded view.
Figure 6E:
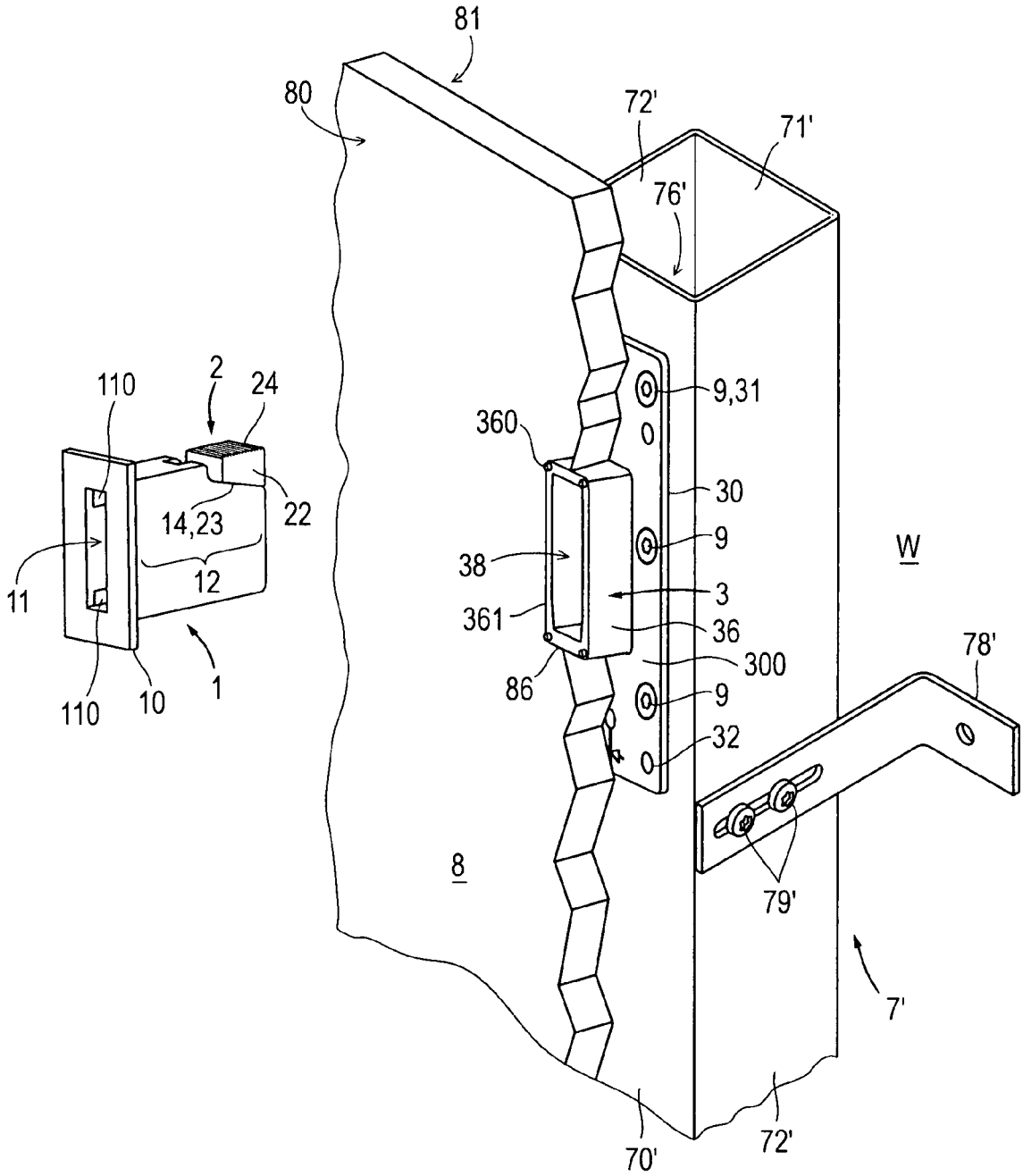
FIG. 6E shows the holder according to FIG. 3A inserted into a hollow vertical pillar and covered from the front by an attachment plate, with a complete plug-in sleeve nearby, in a perspective partial section.

The single-part holder 3, which is likewise preferably produced as a cast part, is basically divided into the perpendicular, plate-like flange 30 and the housing 37 centrally penetrating the flange 30, with a relatively short excess length 36, which ends with the housing front 361, protruding over the front side 300 of the flange 30. The housing 37 has a rectangular cross section oriented upright and encloses a receiving space 38 which is open at the front and rear and into which the shaft 12 can be inserted. To increase the strength of the holder 3, cross-shaped ribs 39 which open on the flange rear side 301 extend from the rear part of the housing 37. The flange 30 is provided with a plurality of first and second screw holes 31, 32 and has a respective leveling marking 33 on the front side 300 on the vertical center axis above and below the excess length 36. A respective cam 35 is located on the flange rear side 301, as it were behind the two leveling markings 33, and an installation marking 34 is located to the side of the flange 30. Marking cams 360 rise up from the housing front 361 in the corner regions and, when pressed onto a panel rear side 71, leave behind a marking for the production of a cutout 76 (see FIG. 6D).

FIGS. 4A and 4B

The support 4 with the straight rod part 41, which is rectangular in cross section, is provided at the first end 411 with a bracket 40 of a first variant made of flat material, the plug-in part 400 of which is intended for insertion into the plug-in sleeve 1. At the second end 412, the rod part 41, which is composed of tubular material, is provided with a covering 413 for closing the cross-sectional opening and, on the upper side, has a conventional stopper 410 which prevents suspended clips from slipping down. The plug-in part 400 merges into a connecting part 407 which is fixed in the first end 411, for example by welding, to which end use is made of the upper and lower expanded portions 408,409. At the transition between the connecting part 407 and the plug-in part 400 there is a lower clearance cut 406, from which a second shoulder 402 extends in the direction of a lower bevel 405. The bevel 405 merges into the vertical front edge 404. On the upper side, an upper clearance cut 406' extends from the transition between connecting and plug-in parts 407,400 to a first shoulder 401 which strikes against a lug 403 which rises up over the first shoulder 401 and ends at the front with the front edge 404. The bracket 40 is advantageously produced, for example, by means of laser cutting.

FIGS. 5A and 5B

The bracket 42 of a second variant serves to support an inserted shelf 6, for example made of glass, is made from a claw-like blank and is likewise produced from flat material. The plug-in part 400 has an identical geometry to the bracket 40 according to the first variant and therefore has a first and a second shoulder 401,402, the lug 403, the front edge 404, the lower bevel 405 and the two clearance cuts 406,406'. Opposite the lug 403 which rises up freely, the plug-in part 400 is adjoined by an upper limb 420 and a longer lower limb 427 between which a recess 423, which runs as far as a vertical inner edge 422, is located. The lower clearance cut 406 on the plug-in part 400 extends downward into the lower limb 427 as far as the vertical limb front 425. In the upper limb 420 there is a hole 421 and, offset with respect thereto, there is a hole 424 in the lower limb 427, the upper edge of the lower limb 427 having a step 426. A respective protective element 51,52, serving as protection against slipping and against abrasion for an inserted shelf 6, is plugged onto both limbs 420,427. The first protective element 51 is L-shaped in the outer contour and has a U-shaped cross section with lugs 510 which are located on the inside and, in the plugged-on state, engage in the hole 421, the protective element 51 surrounding the upper limb 420 from below and the inner edge 422 from the recess 423. The second protective element 52 is plugged onto the upper edge of the lower limb 427 in the front region thereof, and it is therefore present on the step 426 and its lugs (not visible here) engage in the hole 424. A shelf 6 inserted into the recess 423 rests with its rear region on the second protective element 52 while the first protective element 51 acts as a holding-down means and stop.

FIGS. 6A to 6E

In a first application (see FIGS. 6A to 6D), a panel with a cutout 76 is provided as the supporting structure 7, the holder 3 being fitted on the panel rear side 71 by means of the screws a which engage by means of their threaded shanks 92 from the flange rear side 301 through the second screw holes 32 in the holder flange 30 into the panel rear side 71. The screw heads 90 are placed on the flange rear side 301. The flange front side 300 therefore comes to lie on the panel rear side 71 and the housing excess length 36 projects into the cutout 76. The positionally correct installation of the holder 3 can be read by way of the installation marking 34. The plug-in sleeve 1, which is loosely preassembled with the wedge 2 and the screw 9, can now be pushed by means of the shaft 12 into the receiving space 38 in the holder 3 until the rear side of the flange 10 of the plug-in sleeve 1 sits on the panel front side 71. In the example shown here, the plug-in sleeve 1 is provided within the passage 11 with clamping surfaces 110 which contribute to the stabilization in the end position of the plug-in part 400 of a bracket 40,42 fitted into the plug-in sleeve 1. Subsequently, in order to fix the plug-in sleeve 1, which is introduced by means of its shaft 12 in the holder housing 38, the screw 9 is tightened by means of a tool through the passage 11, and therefore the wedge 2 travels upward on the sloping plane—formed by wall slopes 14 and oblique surfaces 23—and the surface structure 24 is pressed against the ceiling of the housing 37 in a clamping manner from the inside.

In the second application (see FIG. 6E), a vertical pillar, preferably made of square tube, is used as the supporting structure 7'. On the hollow vertical pillar 7' which is, for example, square in cross section, the front side 70', the opposite rear side 71' and the two side surfaces 72' are denoted. A fixing clip 78', which is fastened to the side surface 72' of the pillar 7' by means of screws 79', is secured on a rear wall W. On the front side 70' there is a cutout 76' (concealed here) through which the housing 37 of the holder 3 projects into the cavity of the pillar 7'. The flange 30 of the holder 3 rests on the front side 70' and is fastened to the pillar 7' by means of screws 9 which sit in the first screw holes 31. In this arrangement, the second screw holes 32 remain unoccupied. The excess length 36 protrudes from the front side 300 of the flange 30 and sits in a cutout 86 of an attachment plate 8. The attachment plate 8 is directed with its front side 80 into the room, its rear side 81 sits on the flange 30 and the space at the rear and the structure are covered by the attachment plate 8 which is fastened at certain positions. After the plug-in sleeve 1 is inserted into the receiving space 38, the flange 10 comes to lie on the front side 80 and therefore covers the housing front 361 and the edge of the cutout 86. By means of the wedge 2, the plug-in sleeve 1, which is inserted into the holder 3, is fixed in the previously described manner.

Figure 7C:
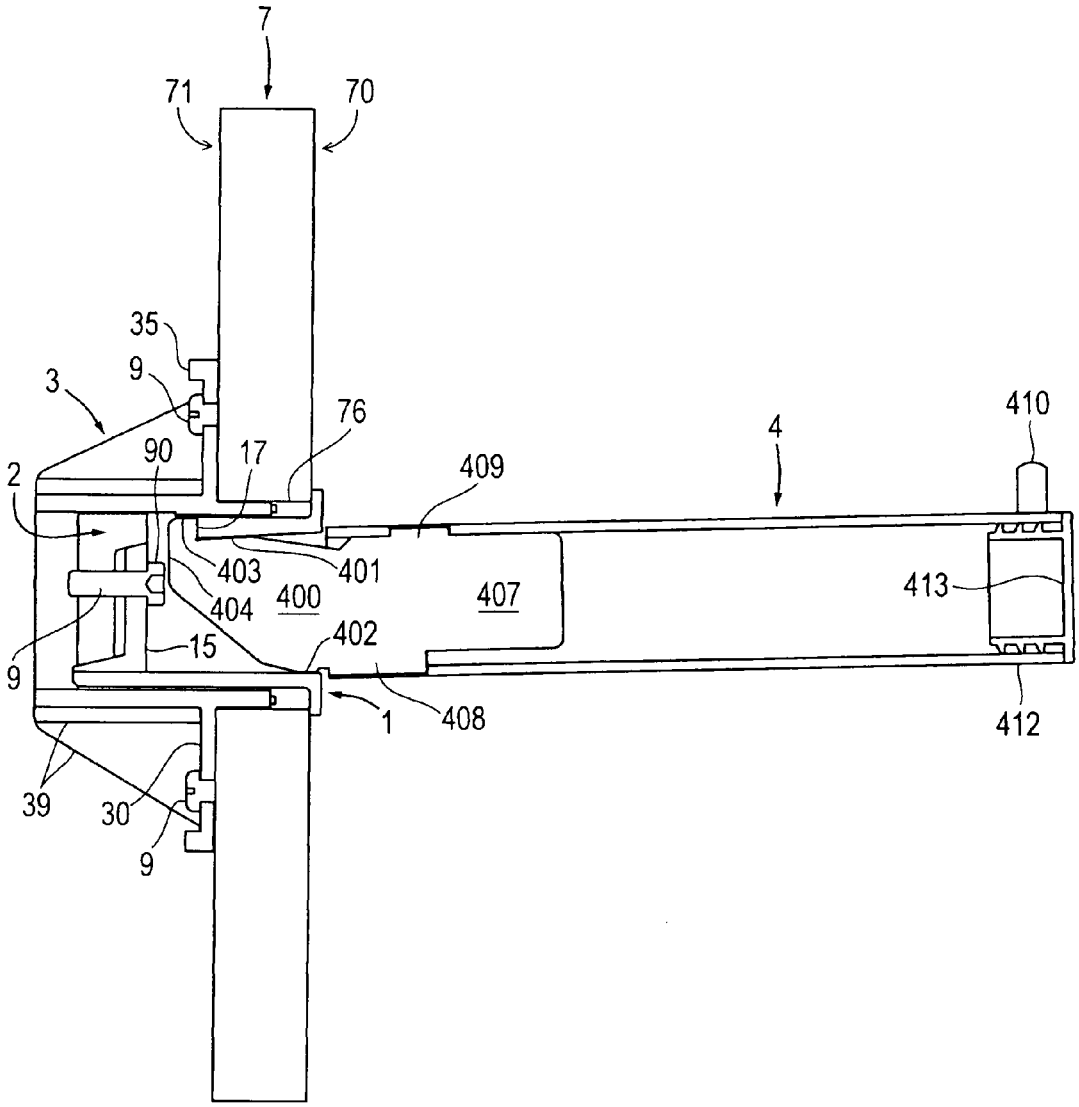

FIGS. 7A to 7C

This sequence of figures illustrates the principle of the function of the device in the three position phases. In the first position phase (see FIG. 7A), illustrated without the holder 3 which surrounds the plug-in sleeve 1, for the imminent introduction of the plug-in part 400 of the bracket 40 into the passage 11 of the plug-in sleeve 1 the entire support 4 is raised obliquely with respect to the horizontal at its second end 412, and therefore the plug-in part 400 with the lug 403 is inclined downward.

In the second position phase (see FIG. 7B), still shown without holder 3, the plug-in part 400 is inserted successively into the passage 11, with the oblique position of the entire support 4 being maintained, until the lug 403 comes to lie under the opening 17. When the insertion has advanced, the second shoulder 402 in the vicinity of the mouth of the passage 11 begins to be placed on the inner wall which is formed by the flange 10 and the adjoining shaft 12.

In the third position phase (see FIG. 7C), now shown with holder 3 and first panel 7, by movement of the support 4 in the direction of the horizontal the lug 403 is inserted into the opening 17 where it finds room in the space toward the inner wall of the holder 3. The front edge 404 of the plug-in part 400 is situated virtually on the screw head 90, the second shoulder 402 is placed at the bottom in the passage 11 in the vicinity of the mouth thereof while the first shoulder 401 is supported at the top on the inner wall of the shaft 12. The support 4 is therefore locked against being pulled out horizontally. The removal of the support 4 from the plug-in sleeve 1 takes place in the reverse manner.

The invention claimed is:

1. A device for suspending articles or for holding a shelf (6), comprising:

a) a holder (3) sized to fasten to a supporting structure (7,7');

b) a plug-in sleeve (1) sized to insert into the holder (3); and c) a support (4) which has a plug-in part (400) to be introduced in a lockable manner into the plug-in sleeve (1); wherein d) the holder (3) has:

da) a vertically arranged flange (30) which serves for the fastening to the supporting structure (7,7'); and db) a first fixing means (37) in the form of a housing which is connected to the flange (30) and has an opening into an inner receiving space (38);

the first fixing means (37) serves for the fixed, releasable securing of the plug-in sleeve (1) inserted in the receiving space (38);

e) the plug-in sleeve (1) has:

ea) a flange (10) which surrounds a window-like mouth of a passage (11);

eb) a shaft (12) which adjoins the flange (10) and into which the passage (11) extends;

ec) a second fixing means (2) which interact with the first fixing means (37) of the holder (3);

ed) a locking element (17) for the releasable engagement of the plug-in part (400) introduced into the sleeve shaft (12); and f) the plug-in part (400) has a counter-element (403) which interacts with the locking element (17) in the sleeve shaft (12), wherein g) the first fixing means (37) comprising an inner housing wall, and the second fixing means (2) of the plug-in sleeve (1) is an adjustable wedge (2) pressing against the inner housing wall; and h) the locking element (17) in the sleeve shaft (12) is a clearance (17) and the complementary counter-element (403) on the plug-in part (400) is an upwardly directed lug (403).

2. The device as claimed in claim 1, wherein a) for the adjustment of the wedge (2) use is made of a screw (9) which has a seat (16) in the sleeve shaft (12) and, for the adjustment, is accessible through the passage (11);

b) the screw (9) engages by a threaded shank (92) in the wedge (2);

c) the upper side of the sleeve shaft (12) has a wall slope (14) on which the wedge (2) can slide to a limited extent; and d) with the plug-in sleeve (1) fixed in the first fixing means (37), the upper side of the wedge (2), which is provided with texturing (24), is pressed against an upper inner housing wall.

3. The device as claimed in claim 2, wherein a) the screw seat (16) in the sleeve shaft (12) is upwardly open, an upwardly open slot (13) extends into the transverse wall (15) which forms the seat (16), and the sleeve shaft (12) is upwardly open as far as the rear end in the region of the wall slope (14), to allow the screw (9) to be placed from above into the seat (16); and b) the wedge (2) has a lower segment (21) with an internal threaded hole (20) for the engagement of the threaded shank (92) of the screw (9), said segment (21) being accommodated in a wedge seat (18) in the sleeve shaft (12).

4. The device as claimed in claim 3, wherein a) the locking element (17) in the sleeve shaft (12) is provided in the form of a hole through its ceiling; and b) in the passage (11) clamping surfaces (110) are provided for reducing the play of an inserted plug-in part (400) resting in the end position.

5. The device as claimed in claim 4, wherein a) the holder flange (30) has screw holes (31,32) for fastening by a front side (300) or a rear side (301) to the supporting structure (7,7');

b) the first fixing means (37) protrudes over the flange front side (300) with an excess length (36) and a remaining part of the first fixing means (37) rises up from the flange rear side (301); and c) leveling and installation markings (33,34) are provided on the holder flange (30).

6. The device as claimed in claim 5, wherein the plug-in part (400) constitutes the frontmost portion of a bracket (40,42) which is composed of vertically positioned flat material; and a) the bracket (40) is connected fixedly to a rod part (41) of an arm-shaped support (4); or b) the plug-in part (400) of the bracket (42) continues in an upper and a lower limb (420,427) between which a recess (423) is located to receive the rear edge of a shelf (6).

7. The device as claimed in claim 6, wherein on the plug-in part (400):

a) a lower clearance cut (406) for the transition to the rod part (41) or to the limbs (420,427), from which a second shoulder (402) extends in the direction of a lower bevel (405);

b) a vertical front edge (404) which comes from the lug (403) and merges into the bevel (405); and c) a first shoulder (401) which leads to the lug (403), lies below the latter and merges into an upper clearance cut (406');

d) the bracket (40) being produced by laser cutting.

8. The device as claimed in claim 7, wherein a) the configuration of plug-in part (400) and plug-in sleeve (1) cooperates to insert the plug-in part (400) into the plug-in sleeve (1) only in a position of the support (4) in which the plug-in part (400) is overall inclined with respect to the horizontal, with the plug-in part (400) lowered; and b) the engagement between the counter-element (403) on the plug-in part (400) and the locking element (17) in the sleeve shaft (12), as a locked state, arises after the support (4) moves as a whole into the horizontal with the plug-in part (400) lying horizontally.

9. A structure with the device as claimed in claim 8, wherein, in the fitted state, a) the holder flange (30) is fastened on the rear side (71) of a supporting structure (7) and the excess length (36) of the first fixing means (37) comes to lie in a cutout (76) of the supporting structure (7);

b) the plug-in sleeve (1) is fixed by the shaft (12) in the receiving space (38) of the holder (3), and the sleeve flange (10) sits with a rear side on the front side (70) of the supporting structure (7); and c) a support (4) is fitted by the plug-in part (400) into the passage (11) of the plug-in sleeve (1).

10. The structure with the device as claimed in claim 8, wherein, in the fitted state, a) the holder flange (30) is fastened on the front side (70') of a supporting structure (7'), in the form of a square tube, and the remaining part of the first fixing means (37) located behind the holder flange (30) projects into the supporting structure (7');

b) the excess length (36) of the first fixing means (37) projecting into the room from the front side of the holder flange (30) lies in a cutout (86) of a plate element (8) which is placed in front of the supporting structure (7') and a front side (80) of the plate element (8) points into the room; and c) the plug-in sleeve (1) is fixed by the shaft (12) in the receiving space (38) of the holder (3), and the sleeve flange (10) sits with a rear side on the front side (80) of the plate element (8); and d) a support (4) is fitted by the plug-in part (400) into the passage (11) of the plug-in sleeve (1).

11. A device for suspending articles or for holding a shelf (6), comprising:

a) a holder (3) sized to fasten to a supporting structure (7,7');

b) a plug-in sleeve (1) sized to insert into the holder (3); and c) a support (4) which has a plug-in part (400) to be introduced in a lockable manner into the plug-in sleeve (1); wherein d) the holder (3) has:

da) a vertically arranged flange (30) which serves for the fastening to the supporting structure (7,7'); and db) a first fixing means (37) in the form of a housing which is connected to the flange (30) and has an opening into an inner receiving space (38);

the first fixing means (37) serves for the fixed, releasable securing of the plug-in sleeve (1) inserted in the receiving space (38);

e) the plug-in sleeve (1) has:

ea) a flange (10) which surrounds a window-like mouth of a passage (11);

eb) a shaft (12) which adjoins the flange (10) and into which the passage (11) extends;

ec) a second fixing means (2) which interact with the first fixing means (37) of the holder (3);

ed) a locking element (17) for the releasable engagement of the plug-in part (400) introduced into the sleeve shaft (12); and f) the plug-in part (400) has a counter-element (403) which interacts with the locking element (17) in the sleeve shaft (12), wherein g) the first fixing means (37) comprising an inner housing wall, and the second fixing means (2) of the plug-in sleeve (1) is an adjustable wedge (2) pressing against the inner housing wall; and h) the locking element (17) in the sleeve shaft (12) is a clearance (17) and the complementary counter-element (403) on the plug-in part (400) is an upwardly directed lug (403);

i) for the adjustment of the wedge (2) use is made of a screw (9) which has a seat (16) in the sleeve shaft (12) and, for the adjustment, is accessible through the passage (11);

j) the screw (9) engages by a threaded shank (92) in the wedge (2);

k) the upper side of the sleeve shaft (12) has a wall slope (14) on which the wedge (2) can slide to a limited extent; and l) with the plug-in sleeve (1) fixed in the first fixing means (37), the upper side of the wedge (2), which is provided with texturing (24), is pressed against an upper inner housing wall.

* * * * *